US007131156B1

(12) United States Patent
Walker-Craft

(10) Patent No.: US 7,131,156 B1
(45) Date of Patent: Nov. 7, 2006

(54) MULTIPURPOSE PILLOW

(76) Inventor: Tangela Yvonne Walker-Craft, 7206 Hileman Dr. West, Lakeland, FL (US) 33810

( * ) Notice: Subject to any disclaimer, the term of this patent is extended or adjusted under 35 U.S.C. 154(b) by 0 days.

(21) Appl. No.: 11/226,955

(22) Filed: Sep. 15, 2005

(51) Int. Cl.
*A47G 9/02* (2006.01)

(52) U.S. Cl. ..... 5/655; 5/646; 5/639; 5/640

(58) Field of Classification Search ..... 5/636, 5/639, 640, 645–647, 655, 419
See application file for complete search history.

(56) References Cited

U.S. PATENT DOCUMENTS 3,378,860 A * 4/1968 Frazier ..... 5/491
4,298,103 A * 11/1981 De Fries ..... 190/1
4,393,520 A * 7/1983 Koch ..... 2/16
D315,845 S * 4/1991 Lafley ..... D6/601
5,081,727 A * 1/1992 Ippolito ..... 5/419
5,159,727 A * 11/1992 McCracken ..... 5/655
5,239,717 A * 8/1993 Sue ..... 5/655
5,361,435 A * 11/1994 Reeves ..... 5/419
5,435,025 A * 7/1995 Gerard et al. ..... 5/419
5,440,769 A * 8/1995 Thomas ..... 5/655
5,918,332 A * 7/1999 Dees ..... 5/639
6,041,458 A * 3/2000 Vickers et al. ..... 5/636
6,381,786 B1 * 5/2002 Cadden ..... 5/655

* cited by examiner

*Primary Examiner*—Michael Trettel
(74) *Attorney, Agent, or Firm*—Yaté K. Cutliff

(57) ABSTRACT

A MULTIPURPOSE PILLOW that includes a tubular body formed with a substantially soft and resilient material between a fabric enclosure. The tubular body has a central channel for receiving a caregiver's arm. The tubular body has a pocket and a cover interconnected to the tubular body. The cover is sized to extend from the tubular body and operate as a blanket. Further, the cover is sized to fit inside the pocket of the tubular body when not being used.

18 Claims, 3 Drawing Sheets

MULTIPURPOSE PILLOW

BACKGROUND OF THE INVENTION

1. Field of the Invention

The present invention relates to a multipurpose pillow and more particularly pertains to an easily transportable and light weight pillow for use in cradling infants and small children with a retractable cover.

2. Description of the Related Art

The use of a pillow made typically of a fabric bag stuffed with a soft material is known in the prior art. More specifically, nursing pillows heretofore devised and utilized for the purpose of cradling and holding the head of infants and small children are known to consist basically of familiar, expected, and obvious structural configurations, notwithstanding the myriad of designs encompassed by the crowded prior art, which have been developed for the fulfillment of countless objectives and requirements. Additionally, conventional pillows generally provide a soft cushion on which to place the head of an infant, child, or adult while resting or sleeping, either in bed, or on upholstered furniture in which case the pillows typically have a permanent fabric cover. Further, there are a number of patents for pillows that have arm receiving openings.

By way of example, the prior art includes U.S. Pat. No. 6,041,458 to Vickers, et al., which discloses a tubular pillow that includes a cover tube and method for enclosing the inside and outside surfaces of the tubular pillow with the cover tube. The tubular pillow has a tubular body formed of a soft and resilient material with a central tunnel passing through longitudinally. The length of the tubular pillow of Vickers, et al. is such that it substantially encompasses the entire length of an average arm. The cover of Vickers, et al. is a separate component. The cover tube is a fabric tube having closure elements preferably of the snap fastener type. The cover tube is mounted onto the tubular body by passing through the central tunnel and bringing each end of the cover tube around the tubular body with a set of snap fasteners engaging a complementary set of snap fasteners on the tubular body. When the cover tube is assembled to the tubular body, the tubular pillow of the invention simulates the appearance of a conventional pillow. This pillow is intended to operate as a conventional pillow and is not easily portable for travel, nursing, or feeding an infant.

U.S. Pat. No. 5,440,769 to Thomas, teaches a generally flat specialty item for supporting a baby's head, while the baby is held by a mother's arm, and includes a soft foam pad shaped to support a baby's head, combined with a fabric case, shaped for attachment around a mother's arm, to thereby fix the pad in place when the item is wrapped around the mother's arm. The device of Thomas has a soft foam pad, with a novel configuration that does not surround the person's arm when placed between layers of fabric to hold it in place. Because of the position of the pad, this pillow requires the infant to remain in a centralized location and stationary to maintain comfort. Further, this item offers no comfort to a child lying down and not being held.

Further, U.S. Pat. No. 5,239,717 to Sue is a pillow for a caretaker's arm for supporting the head of a baby. It cushions the caretaker's arm against the arm of a chair in which the caretaker is sitting while holding the baby. The pillow is tubular to receive a part of the arm of a caretaker. Specifically, the pillow forms a tube when it is expanded from a flattened condition. In a flattened, stored condition, the pillow is comprised of two side-by-side interconnected layers, which lie flat and are juxtaposed relative to each other.

U.S. Pat. No. 5,159,727, to McCracken discloses a child care device that includes a pillow mounted on a baby blanket intermediate the blanket ends. The ends of the blanket are provided with mating fastening means, one on one side of the blanket, one on the other. The blanket is wrapped around the baby holder's arm, so that the pillow is on the upside and the baby's head rests thereon when the baby is being cradled by the baby holder. Other nursing pillows include U.S. Pat. No. 4,393,520 to Koch and U.S. Design Pat. No. Des. 315,845.

Mothers/caretakers of an infant, baby, or small child hereinafter referred to as a baby have cradled and carried babies in their arms since time immemorial. This is generally done, while the caretaker is sitting in a chair, such as a rocking chair, with the head of the baby held against the caretaker's arm. The aforementioned actions can also be performed, while the caretaker is standing. When performing these actions, the caretaker often becomes uncomfortable due to the weight of the baby's head against the caretaker's arm. This causes localized pressure on the arm, resulting in tension, sometimes resulting in swelling and abrasion to the caretaker's arm. In addition, in many cases, the localized pressure on the arm cuts off the blood flow through that portion of the arm, causing the arm to fall asleep and in general, exhibit extreme tiredness or soreness in the arm. Similar discomfort is experienced by the baby in and around its head, neck and shoulders, and other parts of the body.

Because of this problem, attempts have been made to alleviate the discomfort to the caretaker and the baby. For instance, a blanket or ordinary head pillow have been used on the arm by being wrapped around the arm, to cushion the weight of the baby's head and to alleviate the strain on the caretaker's arm, when engaging the arm of the chair. However, these techniques are temporary at best, since the blanket or pillow tends to unwrap quickly due to arm movements of the caretaker and head movements of the baby. These movements cause the blanket and the pillow to become loose on the arm, and they become essentially ineffective in reducing discomfort. Because of this drawback, the caretaker must continually re-adjust the position of the blanket or the pillow to its ideal position.

Another matter that has not been considered in the development of the previous pillows that are used during nursing and feeding is the need for privacy of the mother/caretaker when nursing the baby in public or around non-family adults and children.

There remains a serious disadvantage of the devices currently in use with the baby, when it comes to providing the most comfort to both the caretaker and the baby. Further, the privacy of the mother when nursing has become a major societal issue.

Therefore, it can be appreciated that there exists a continuing need for a new and improved multipurpose pillow, which can be used for an easily transportable and light weight pillow for use in cradling infants and small children with a retractable cover. In this regard, the present invention substantially fulfills this need.

SUMMARY OF THE INVENTION

The present invention provides apparatus for forming an easily transportable and light weight pillow for use in cradling infants and small children with a retractable cover.

Accordingly, a primary use of the multipurpose pillow is to provide a uniquely different pillow that can be used by the caretaker for comfort of the caretaker and baby at all times when the baby is being cradled. As such, the general purpose of the present invention will be described subsequently in greater detail.

To attain this, the present invention essentially comprises a tubular body that is formed with a substantially soft and resilient material between a fabric enclosure. The tubular body has a central channel there through adapted to receive an arm. The fabric enclosure is formed by first and second layers of material. A third layer of material is stitched to the second layer of material to interconnect with the second layer of material along the stitch. The third layer of material is configured for wrapping around the second layer of material to form a pocket. Further, included is a closer flap formed at a free end of the third layer of material after it has been wrapped around the second layer of material of the fabric enclosure. The closer flap is extended the length of the tubular body.

There has, thus, been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

It is, therefore, an object of the present invention to provide a new and improved multipurpose pillow, which has none of the disadvantages of the prior art nursing pillows.

Another object of the present invention is to provide a new and improved multipurpose pillow, which may be easily and efficiently manufactured and marketed.

A further object of the present invention is to provide a new and improved multipurpose pillow, which is of a durable and reliable lightweight material.

An even further object of the present invention is to provide a new and improved multipurpose pillow, which is completely portable.

Still yet another object of the present invention is to provide a new and improved multipurpose pillow, which provides in the apparatuses and methods a pillow that can be used to cradle an infant or baby during nursing or resting of the baby.

It is still a further object of the present invention to provide a multipurpose pillow in the form of a tubular body that cushions an arm within a central channel, while the head of the infant or child rests on the third layer of the pillow.

It is still an object of the multipurpose pillow to provide a privacy cover for a mother/caregiver nursing the baby in public, while the baby's head is resting on the pillow.

An even further object of the present invention is providing a travel pillow that can be used by the caretaker or small child as a pillow.

It is still an object of the multipurpose pillow to provide a pillow and cover for use as a pallet for the infant or child to lie on.

Still another object of the present invention is to provide an easily transportable and light weight pillow for use in cradling infants and small children with a retractable cover.

These together with other objects of the invention, along with the various features of novelty, which characterize the invention, are pointed out with particularity in the claims annexed to and forming a part of this disclosure. For a better understanding of the invention, its operating advantages, and the specific objects attained by its uses, reference should be had to the accompanying drawings and descriptive matter in which there are illustrated preferred embodiments of the invention.

BRIEF DESCRIPTION OF THE DRAWINGS

The invention will be better understood, and objects other than those set forth above, will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figures 1, 2:
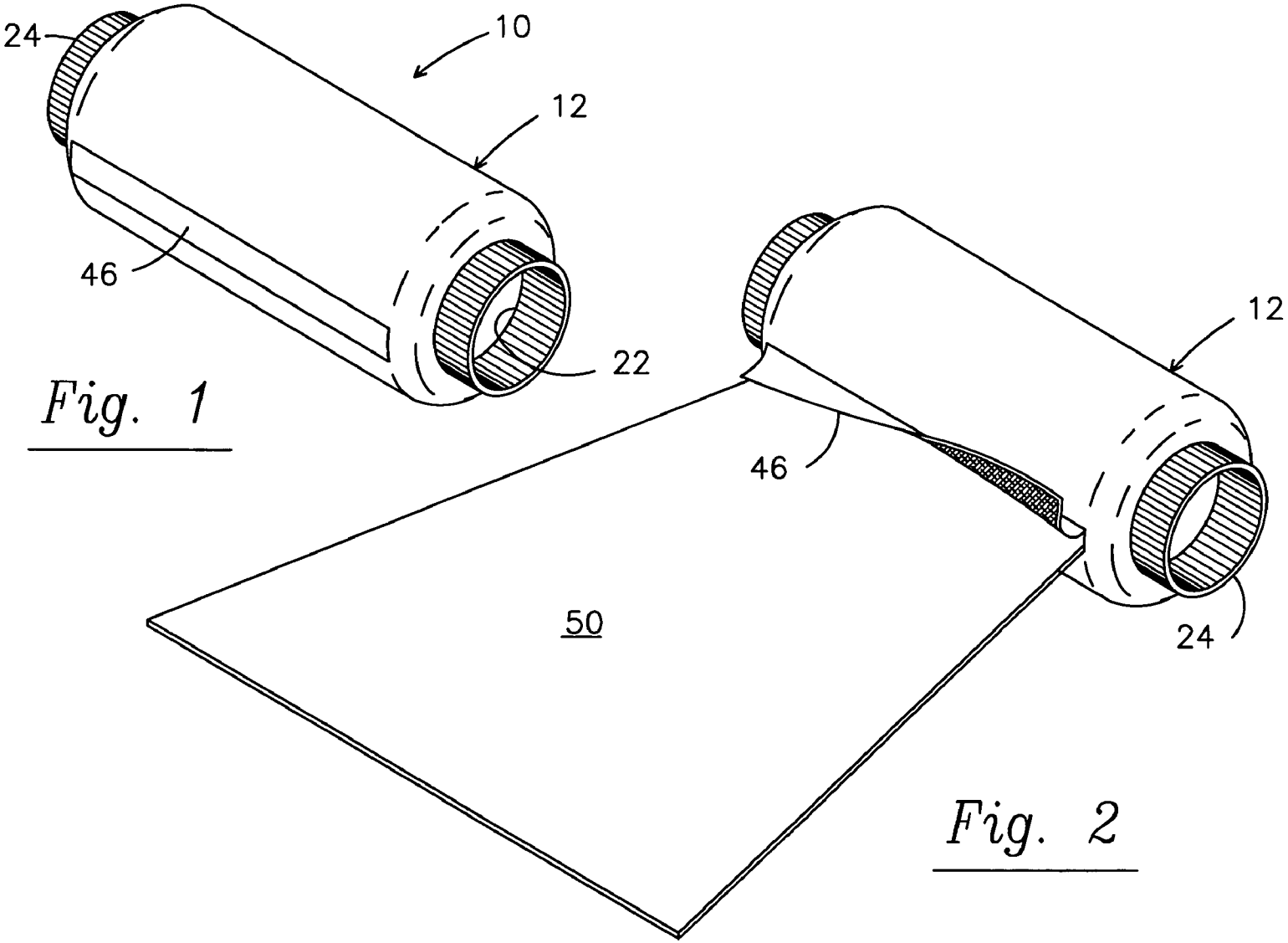
FIG. 1 is a perspective illustration of the preferred embodiment of the multipurpose pillow constructed in accordance with the principles of the present invention.
FIG. 2 is perspective illustration of the multipurpose pillow with the cover extended from the pocket of the tubular body.

With reference now to the drawings, and in particular to FIG. 1 thereof, a multipurpose pillow embodying the principles and concepts of the present invention and generally designated by the reference numeral 10 will be described.

The present invention, the new and improved multipurpose pillow is comprised of a plurality of components. Such components in their broadest context include a tubular body, a third layer forming a pocket, and a retracting cover. Such components are individually configured and correlated with respect to each other so as to attain the desired objective.

Figure 4:
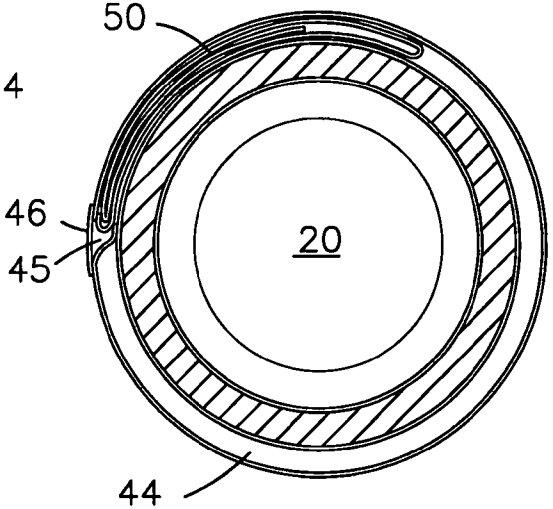
FIG. 4 is a cross sectional view of the present invention taken along lines 4—4 showing the cover in the pocket.

More specifically, the present invention, multipurpose pillow 10, includes a tubular body 12 that is formed by a fabric enclosure. The fabric enclosure formed by a first layer of material 14 and second layers of material 16, with a substantially soft and resilient material 18 between the first and second layers of material, as shown in FIG. 4. The tubular body has a central channel 20 there through that is adapted to receive an arm. The central channel of the tubular body has a pair of opposed open ends 22. Each of the opposed open ends include an elastic band 24 interconnected to the fabric enclosure. The elastic bands are positioned to surround the arm 26 placed through the central channel to hold the tubular body in position on the arm.

The elastic bands 24 can be made adjustable and expandable by having elastic bands where the pillow has a pair of opposed ends. The pair of opposed ends of the elastic bands are coupled together by any known fastening devices, such as, snaps, buttons or pile type fasteners.

The substantially soft and resilient material 18 of the tubular body extends throughout a length and circumferential extent of the tubular body. The substantially soft and resilient material may be memory foam, foam plastic, cotton, batting material, sponge rubber, or other synthetic sponge material.

Figure 5:
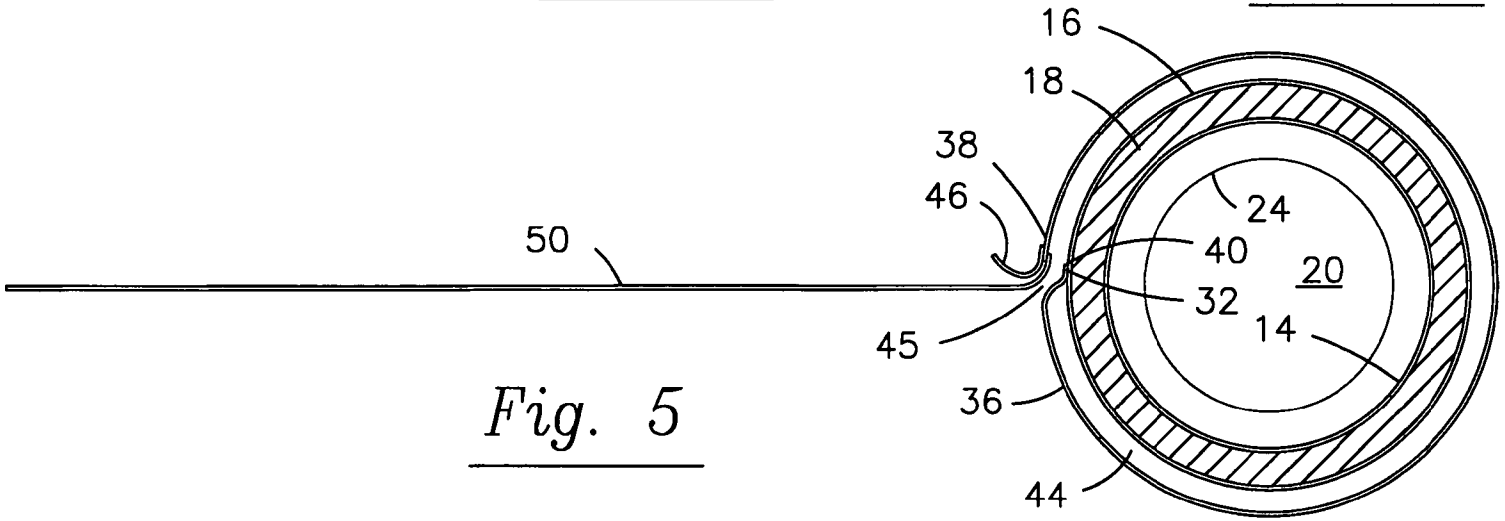
FIG. 5 is a cross sectional view of the present invention taken along lines 4—4 showing the cover extended out of the pocket and away from the tubular body.

Further, the second layer of material 16 of the fabric enclosure is a sheet of material that has a pair of opposed ends 31 that are folded upon themselves. The second layer of material is stitched 32 to interconnect the pair of opposed ends and enclose the substantially soft and resilient material about the first layer of material as shown in FIGS. 4 and 5. The invention has a first layer of material that forms a tube. The first layer is wrapped by a soft and resilient material; then, a second layer of material is enclosed about the soft resilient material, to create the fabric enclosure of the tubular body.

As depicted in FIGS. 4 and 5, a third layer of material 36 is included. The third layer of material has a free end 38 and an attached end 40. FIG. 5 illustrates that the attached end is stitched simultaneously to the pair of opposed ends 31 of the second layer of material, to interconnect with the second layer of material along the stitch 32. The third layer of material is configured for wrapping around the second layer of material to form a pocket 44 pocket opening 45, when the side edges are stitched in place along with the side edges of the first and second layers of material. The pocket is formed about a length and circumferential extent of the second layer of the tubular body. The pocket is sized to accessories useful in child care, such as, pre-packaged baby wipes. The pocket is especially useful for hands free changing of the baby.

Figure 3:
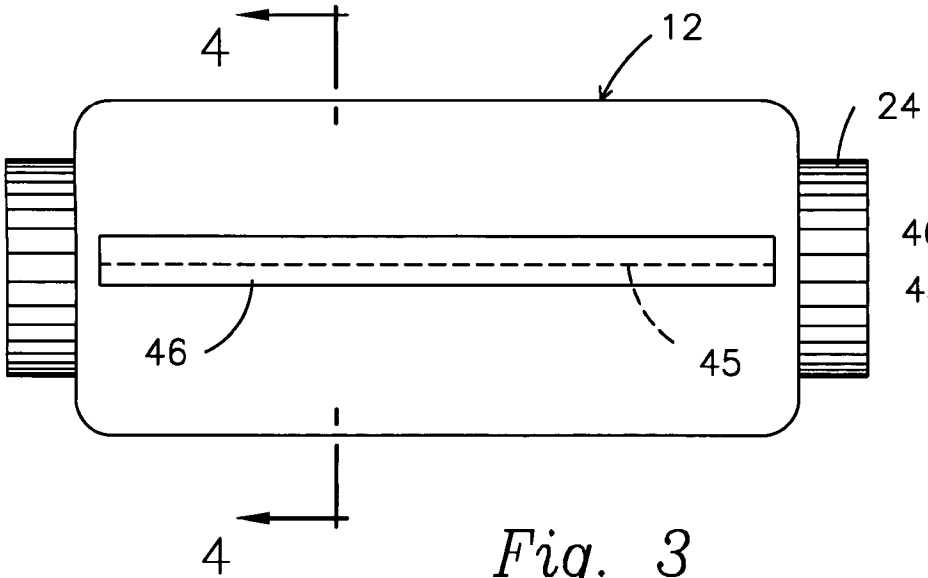
FIG. 3 is a frontal view of the present invention.

In addition to creating the pocket, the free end of the third layer is used to form a closure flap 46, at the free end 38 to cover the pocket opening. The closure flap is made from a portion of the fabric used to make the third layer of material after it has been wrapped around the second layer of material of the fabric enclosure. The closure flap substantially extends the length of the tubular body, as shown in FIGS. 1, 2 and 3. The preferred, closure flap is flexible and weighted to automatically fold over the pocket opening 45. The interior side of the closure flap is maintained free of any fasteners to prevent the baby from being scratched. However, the closure flap can have a pile type fastener member on its interior side for coupling with a corresponding pile type fastener member attached juxtapose the stitch 32 interconnecting the second layer of material and third layer of material.

Figure 6:
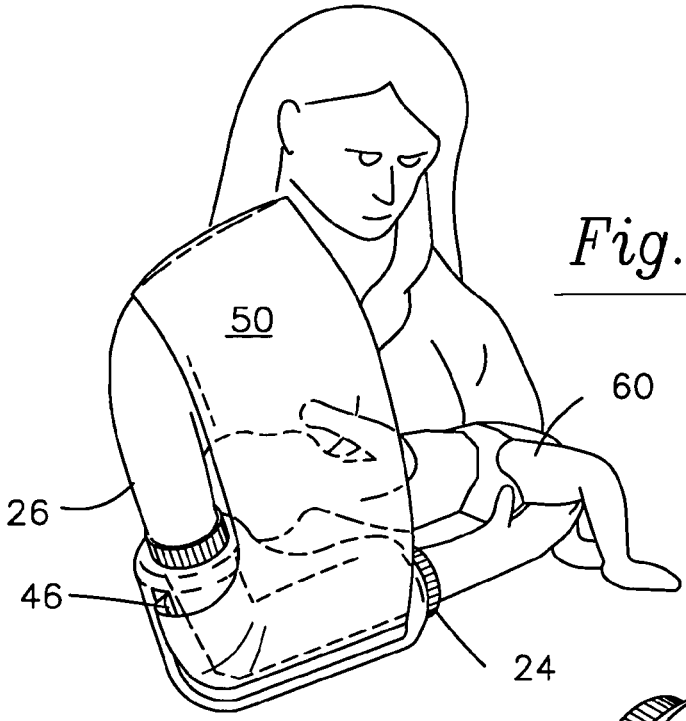
FIG. 6 is an elevational view of a baby's head resting on the pillow with the cover pulled over the baby and the caretaker's shoulder.

As best illustrated in FIG. 2, a cover 59 is interconnected at one end to the free end 38 of said third layer of material 36, with the cover sized to be stored within the pocket 44. The cover, as shown, has a body that is trapezoidal in shape and extends a set distance from the closure flap 46. However, the body part of the cover is not limited to this shape and can be rectangular, semi-elliptical, semi-circular or diamond shape. The body part of the cover is sized for use as a blanket that can be draped over a child, whose head is resting on the tubular body when the tubular body is positioned over the arm, as seen in FIG. 6. Additionally, the cover is sized to provide a nursing mother a privacy blanket when nursing in public or around non-family adults and/or children. The interconnected end of the cover is generally linear for securing near the cover flap, with the interconnected end of the cover having a length substantially equal to or at least one half the length of the cover flap. The cover is sized to fit within the pocket of the tubular body. The cover 50 is either folded and/or manually retracted and placed within the pocket, as depicted in FIG. 4. The cover, inside the pocket, can be smoothed out to reduce the lumpiness of the multipurpose pillow.

The multipurpose pillow, with its unique shape and features is most useful during nursing of an infant 60 or child 60. During nursing, the mother simply places the tubular body formed by a fabric enclosure with a pair of open opposing ends for her arm. This is done by placing the arm through the pair of open opposing ends and extending the arm through a channel 20 of the tubular body 12. Once the tubular body is positioned over the arm, the cover 50 is extended from a pocket of the tubular body. The cover can be extended prior to arm placement. Next, the head of the infant or child is laid against the tubular body. The mother then drapes the extended cover taken from the pocket of the tubular body over the body of the infant and over her shoulder prior to nursing, as shown in FIG. 6.

Figure 7:
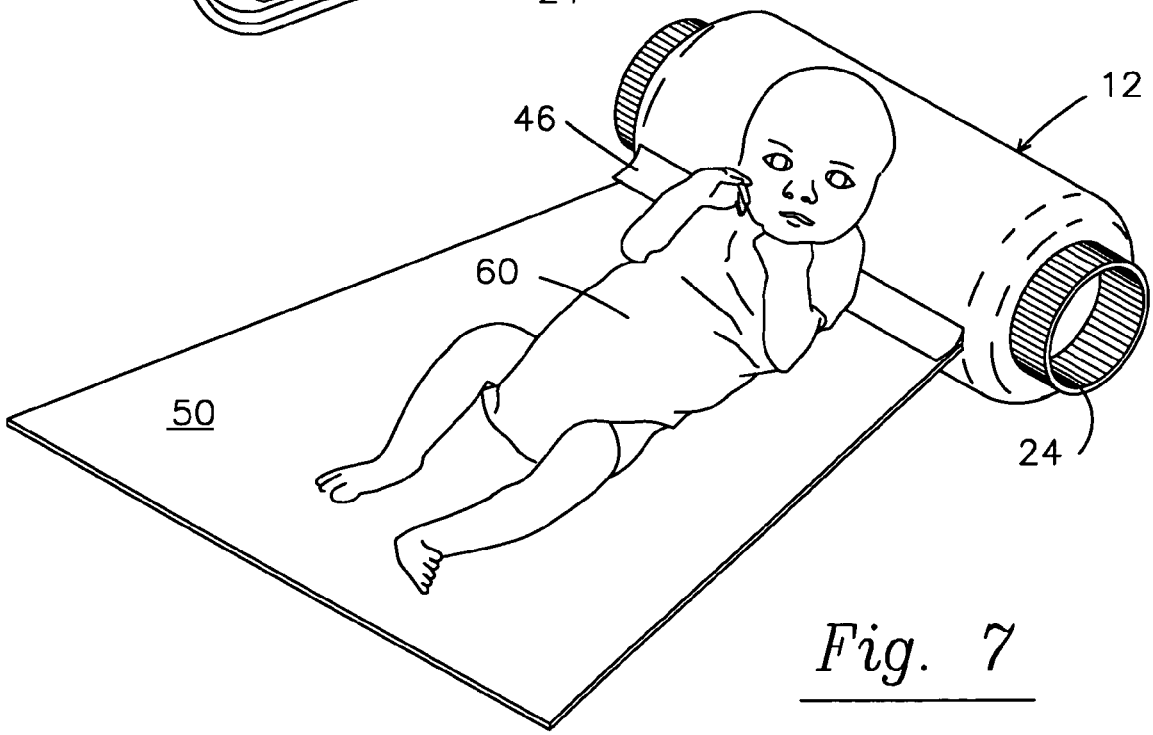
FIG. 7 is the perspective illustration of the present invention in use as a pallet by the baby.

Furthermore, multipurpose pillow is useful as a pallet, as shown in FIG. 7. In this way the pallet is used to lay the infant or child on for changing, napping, or just periods of resting. In this instance, the cover is pulled out of the pocket of the tubular body. Then, the cover and tubular body are laid on a flat surface. The caregiver lays the head of an infant or child against the tubular body and rests a body of the infant or child on the cover.

There are many other ways the caregiver can use the multipurpose pillow. The multipurpose pillow can be used any time the caregiver holds or carries an infant or child. An older child can even use the multipurpose pillow as their personal travel or portable pillow and blanket.

The multipurpose pillow consists of an inner core of soft, pliable cushion foam and a washable outer fabric cover. The multipurpose pillow cushions and protects the arm of the caregiver during feeding, nursing, or general comforting of an infant or child. The hidden, cover feature of the device allows the mother and baby privacy during public breast feedings. The cover when not in use tucks neatly inside of an invisible pocket between the second and third layer of material.

Therefore, the foregoing is considered as illustrative only of the principles of the invention. It is not intended to be exhaustive or to limit the invention to the precise forms disclosed. Obvious modifications or variations are possible in light of the above teachings. The embodiments discussed were chosen and described, to provide the best illustration of the principles of the invention and its practical application, to thereby enable one of ordinary skill in the art to utilize the invention in various embodiments and with various modifications, as are suited to the particular use contemplated. All such modifications and variations are within the scope of the invention, as determined by the appended claims when interpreted in accordance with the breadth to which they are fairly, legally, and equitably entitled.

What is claimed is as follows:

1. A multipurpose pillow comprising:

a tubular body formed by a fabric enclosure having first and second layers of material with a substantially soft and resilient material between the first and second layers of material that form the fabric enclosure, the tubular body having a central channel there through adapted to receive an arm, the substantially soft and resilient material extending throughout a length and circumferential extent of the tubular body;

the second layer of material being a sheet of material having a pair of opposed ends being folded upon themselves, the second layer of material being stitched to interconnect the pair of opposed ends and enclose the substantially soft and resilient material about the first layer of material;

a third layer of material having a free end and an attached end, with the attached end being stitched simultaneously to the pair of opposed ends of the second layer of material to interconnect with the second layer of material along the stitch, said third layer of material configured for wrapping around the second layer of material to form a pocket; and a closure flap at the free end of the third layer of material having been wrapped around the second layer of material of the fabric enclosure, with the closure flap extending the length of the tubular body.

2. The multipurpose pillow as set forth in claim 1, wherein the central channel of the tubular body having a pair of opposed open ends.

3. The multipurpose pillow as set forth the in claim 2, further including elastic bands positioned at each of the pair of opposed ends and interconnected to the fabric enclosure, the elastic bands are positioned to surround the arm placed through the central channel to hold the tubular body in place.

4. The multipurpose pillow as set forth in claim 1, wherein the first, second, and third layers of material are made of a soft fabric.

5. The multipurpose pillow as set forth in claim 1, wherein the pocket formed about a length and circumferential extent of the second layer of the tubular body.

6. The multipurpose pillow as set forth in claim 5, wherein the pocket is sized to hold accessories in child care.

7. The multipurpose pillow as set forth in claim 1, wherein the closure flap having pile type fastener member, and a corresponding pile type fastener member being attached juxtapose the stitch interconnecting the second layer of material and the third layer of material.

8. The multipurpose pillow as set forth in claim 1, further including a cover interconnected at one end to the free end of said third layer of material, with the cover sized to be stored within the pocket.

9. The multipurpose pillow as set forth in claim 7, wherein said cover having a length for extending a set distance from the closer flap.

10. The multipurpose pillow as set forth in claim 9, wherein the cover is sized for use as a blanket that can be draped over a child, whose head is resting on the tubular body when positioned over the arm.

11. The multipurpose pillow as set forth in claim 9, wherein the cover is sized for use as a blanket that can be placed on any surface for laying a child onto when the child's head is resting on the tubular body.

12. The method of using a multipurpose pillow as set out in claim 2, during nursing of an infant or child, comprising the steps of:

(a) providing a tubular body formed by a fabric enclosure with a pair of open opposing ends;

(b) placing an arm of a caregiver through the pair of open opposing ends for extending through a channel of the tubular body;

(c) extending a cover from a pocket of the tubular body;

(d) laying a head of an infant or child against the tubular body; and (e) draping the cover extended from the pocket of the tubular body over a body of the infant and a shoulder of the caregiver.

13. The method of using a multipurpose pillow as set out in claim 2, as a pallet for laying an infant or child, comprising the steps of:

(a) providing a tubular body formed by a fabric enclosure with a pair of open opposing ends and a cover;

(b) extending the cover from a pocket of the tubular body;

(c) placing the tubular body and cover on a flat surface; and (d) laying a head of an infant or child against the tubular body and resting a body of the infant or child on the cover.

14. The method of using a multipurpose pillow as set out in claim 2, during holding or carrying of an infant or child, comprising the steps of:

(a) providing a tubular body formed by a fabric enclosure with a pair of open opposing ends;

(b) placing an arm of a caregiver through the pair of open opposing end for extending through a channel of the tubular body;

(c) extending a cover from a pocket of the tubular body;

(d) laying a head of an infant or child against the tubular body; and (e) draping the cover extended from the pocket of the tubular body over a body of the infant.

15. A multipurpose pillow comprising:

a tubular body formed with a substantially soft and resilient material between a fabric enclosure, the tubular body having a central channel there through adapted to receive an arm, the fabric enclosure being formed by first and second layers of material;

a third layer of material being stitched to the second layer of material to interconnect with the second layer of material along the stitch, said third layer of material configured for wrapping around the second layer of material to form a pocket; and a closure flap at a free end of the third layer of material having been wrapped around the second layer of material of the fabric enclosure, with the closure flap extending the length of the tubular body.

16. The multipurpose pillow as set forth in claim 15, wherein the substantially soft and resilient material extending throughout a length and circumferential extent of the tubular body.

17. The multipurpose pillow as set forth in claim 15, wherein the second layer of material being a sheet of material having a pair of opposed ends being folded upon themselves, the second layer of material being stitched to interconnect the pair of opposed ends and enclose the substantially soft and resilient material about the first layer of material.

18. The multipurpose pillow, as set forth in claim 17, wherein the third layer of material further includes an attached end and the attached end is simultaneously stitched to the pair of opposed ends of the second layer of material.

* * * * *